United States Patent [19]

Green

[11] 4,000,530

[45] Jan. 4, 1977

[54] INVALID HANDLING DEVICE

[76] Inventor: Booker Green, 1600 Westmoreland Ave., Pittsburgh, Pa. 15206

[22] Filed: June 25, 1975

[21] Appl. No.: 590,383

[52] U.S. Cl. ..... 5/87; 5/84

[51] Int. Cl.[2] ..... A47B 83/04; A61G 01/02

[58] Field of Search ..... 5/61, 81, 83, 84, 86, 5/88, 110, 112, 114

[56] References Cited

UNITED STATES PATENTS

| | | | |
|---|---|---|---|
| 1,273,599 | 7/1918 | Floyd | 5/88 |
| 1,588,573 | 6/1926 | Edmiston | 5/84 |
| 2,272,778 | 2/1942 | Reuter | 5/87 |
| 3,351,959 | 11/1967 | Turpin | 5/89 |
| 3,612,042 | 10/1971 | Fry | 5/81 B |
| 3,671,983 | 6/1972 | Bertolet | 5/114 |
| 3,789,437 | 2/1974 | Gavte | 5/114 |

*Primary Examiner*—Casmir A. Nunberg
*Attorney, Agent, or Firm*—Carothers and Carothers

[57] ABSTRACT

Invalid handling apparatus for lifting patients from one place to another which includes an elongated frame unit supported on four quadrangularly positioned legs with casters. The unit is rolled to a position over the invalid patient and is provided with a series of lifting belts for detachable connection to cooperative connectors on a patient carrier, the latter of which can be made into the bedding of the invalid patient. The patient carrier comprises a matrix of parallel and normally aligned strap members securably stitched at their points of crossing to provide for a flexible mat.

The legs for supporting the frame unit may be adapted for removal from the frame unit or may be adapted to fold upwardly and inwardly toward the bottom of the frame to permit transmittal of the frame unit with the patient on an overhead conveyor system.

7 Claims, 6 Drawing Figures

INVALID HANDLING DEVICE

BACKGROUND OF THE INVENTION

This invention relates generally to invalid beds and more particularly to an invalid lift and transfer (class 5, subclass 81) to permit the handling of an invalid patient for changing of bed clothing or transfer to another place without the need for more than one personnel.

The art concerning equipment and apparatus used for transferring patients or handling invalids is very old having its main surge of beginning in the United States, as far as mechanically operated apparatuses are concerned, around the time of the War between the States. A great need, particularly due to lack of personnel, was experienced for apparatuses that would permit the transfer of patients without undue or unnecessary movement or discomfort to the patient or undue strain on the individual handling the patient, particularly, where the patient is completely immobile and, therefore, difficult to move, carry or otherwise handle. Such apparatus was and is generally used to lift patients for change of bed clothing, or transfer to another bed or room, or for conveniently turning the patient in a bed without hurting the patient. Examples of such earlier type apparatus is found in U.S. Pat. Nos. 229,910; 528,475; and 738,104. In U.S. Pat. No. 528,475, a movable frame is shown which is positioned over a patient or invalid and lifting frame within the movable frame is adapted for lifting the invalid upwardly from the bed by means of a series of bands supporting the patient.

Other types of invalid transfer apparatus are shown in U.S. Pat. Nos. 408,716; 662,477; 1,318,429; 1,782,672; and 2,598,570 which generally provide for means to lift an invalid and then permit transfer of the invalid to another place, if necessary. These invalid transfers however are quite large and are not adequate for the needs particularly in today's modern hospitals, particularly where these lifting devices provided for cables or cable pulley systems to lift a support member upon which the patient is positioned. Undue swing and swaying is caused to occur to the patient while being transferred to another place becoming not only misaligned relative to the movement of the invalid transfer apparatus but also creating a situation of possible injury to the patient by hitting objects as the transfer apparatus is moving thereby.

The most popular invalid transfer used in hospitals today is a tripod frame carrier that sits on a set of three rollers. The transfer is provided with a hoist mechanism to lift the invalid in a sling-like arrangement. A portion of the hoist frame may be rolled under the bed of the invalid so that the hoist and lifting support are directly over the patient. An investigation reveals that hospital personnel do not generally desire to use this type of equipment because the tripod arrangement provides for the possibility of tipping over during use. Also, the invalid is supported in an uncomfortable manner and in a precarious position because of the high possibility of potential swinging of the patient or invalid during movement, endangering the invalid in hitting close and protruding objects passed by the invalid during transfer.

Other examples of prior art invalid transfer apparatuses (Class 5, subclass 91, et seq) are as follows:

| PATENTEE | DATE | NUMBER |
|---|---|---|
| Smith, et al | 7/6/1869 | 92,380 |
| Robbins | 5/16/1882 | 258,124 |
| Demeree | 1/21/13 | 1,050,814 |
| Edmiston | 6/15/26 | 1,588,573 |
| Cottman | 12/10/29 | 1,738,758 |
| Cole | 7/31/34 | 1,968,477 |
| Haskett | 10/23/34 | 2,035,116 |
| Saint (British Patent) | 7/10/33 | 395,024 |

It is a known fact today that costs in hospitalization are rising very rapidly. As a result, hospital and other similar institutions are exploring ways to reduce the cost of hospital administration and operation and many such institutions have taken substantial measures in this direction. One of the measures being taken presently is the reduction of hospital employees, particularly those in administrative capacities and those who render aid in the maintenance of hospital patients, equipment, supplies, etc. which are commonly referred to as nurses' aids. With the reduction in nurses' aides, there are that many less personnel in a hospital to help or render assistance in moving a patient from one place to another or for lifting or turning a patient or invalid to change bed clothing. Very often the task today is left to one individual.

With the growing elimination of such personnel from the hospitals, there is an increasing need of equipment which is simple in design, but automated, that will permit the lifting or turning or transferring of patients and invalids in a hospital by one individual alone. Such equipment to transfer patients from room to room and to other areas of a hospital without any difficulty in maneuverability or possible harm or disturbance to the patient.

The prior art does provide many structural devices for movement of patients, such as found in U.S. Pat. Nos. 2,603,851; 2,918,718; and 3,506,986, but such apparatuses were not designed or constructed with the intent to transfer patients and invalids as well as lift of turn them in their beds so as to provide versatility in usefulness which would be a required necessity into today's hospital. Such apparatus would also have to positively provide adequate safeguards to insure that the patient or invalid is protected from being bumped or placed in contact with objects while the patient is in transit.

Also in the use of such transfer apparatus, adequate patient carriers must be provided that do not rap around or squeeze a patient when lifted from a bed and yet are capable of being made into the bed clothing so that the carrier may be quickly prepared for connection to the invalid transfer apparatus. Examples of prior art patient handling or transfer carriers are shown in U.S. Pat. Nos. 1,338,774 and 2,480,314.

SUMMARY OF THE INVENTION

This invention relates to an invalid handling apparatus for lifting invalid patients which is simple in construction and operation and can be controlled and used by one individual without the need of assistance and yet due to its simplicity of design is readily adaptable for present-day hospitals.

In order to be a useful device, particularly for hospital use, an invalid handling apparatus must be able to negotiate corridors and rooms of such institutions as well as not be too bulky in construction or difficult to operate if one is to design such apparatus for use by one individual. This is the principal feature of the present invention as the prior art structures for handling or transferring invalids are not readily adaptable to hospital use particularly with respect to new concepts being presently developed as to the transfer of patients in such institutions by means of conveyor systems.

The invalid handling apparatus of the present invention is provided with an elongated frame unit in which is housed the mechanism for lifting and lowering patients or invalids as well as the drive means therefor. A quadrangular leg carriage is provided with bracing framework and means is further provided for permitting the legs to be folded up adjacent to a patient lying on a patient carrier supported from the frame unit which may be connected to an overhead conveyor system. At the same time, the legs in folded position act to protect the patient from engagement with objects, building walls and corners, etc. while the frame unit is in motion.

The mobile carriage for the frame unit can be provided to be removed from the frame unit if so desired.

Since the invalid apparatus herein disclosed is intended for mobility whether on its own carriage or on an overhead conveyor system, support strapping or lifting belts are provided in such an arrangement as to prevent undue oscillatory or swing movement of the patient when the frame unit is in motion. Also, the strapping protects the supported patient from being placed in engagement with objects as the frame unit is moved.

Another provision of the present invention is an exercising device that may be included in the frame unit to move the limbs of the patient for the purpose of exercising them. Also a drag cable may be provided in the unit for connection to the patient to aid in pulling the patient upwardly into a sitting position from a prone position. A harness may be provided for the patient to which the drag line may be connected.

Another provision of the present invention is the outwardly disposed bed engaging members attached to at least two legs of the frame unit carriage to engage the bed frame of the patient or invalid so as to maintain the frame unit steady relative bed ridden patient when the apparatus has been positioned over the patient or invalid.

Another provision of this invention is the provision of a flexible mat for supporting the patient and provided with a U-shaped frame to maintain the mat in a spread-out condition and not be wrapped around the patient when lifting the latter; yet capable of being made into the bedding of the patient ready for use when necessary by connection to the frame unit to lift and transfer the patient.

Other objects and advantages appear hereinafter in the following description and claims.

The accompanying drawings show, for the purpose of exemplification without limiting the invention or the claims thereto, certain practical embodiments illustrating the principles of this invention wherein:

Figures 1, 3, 6:
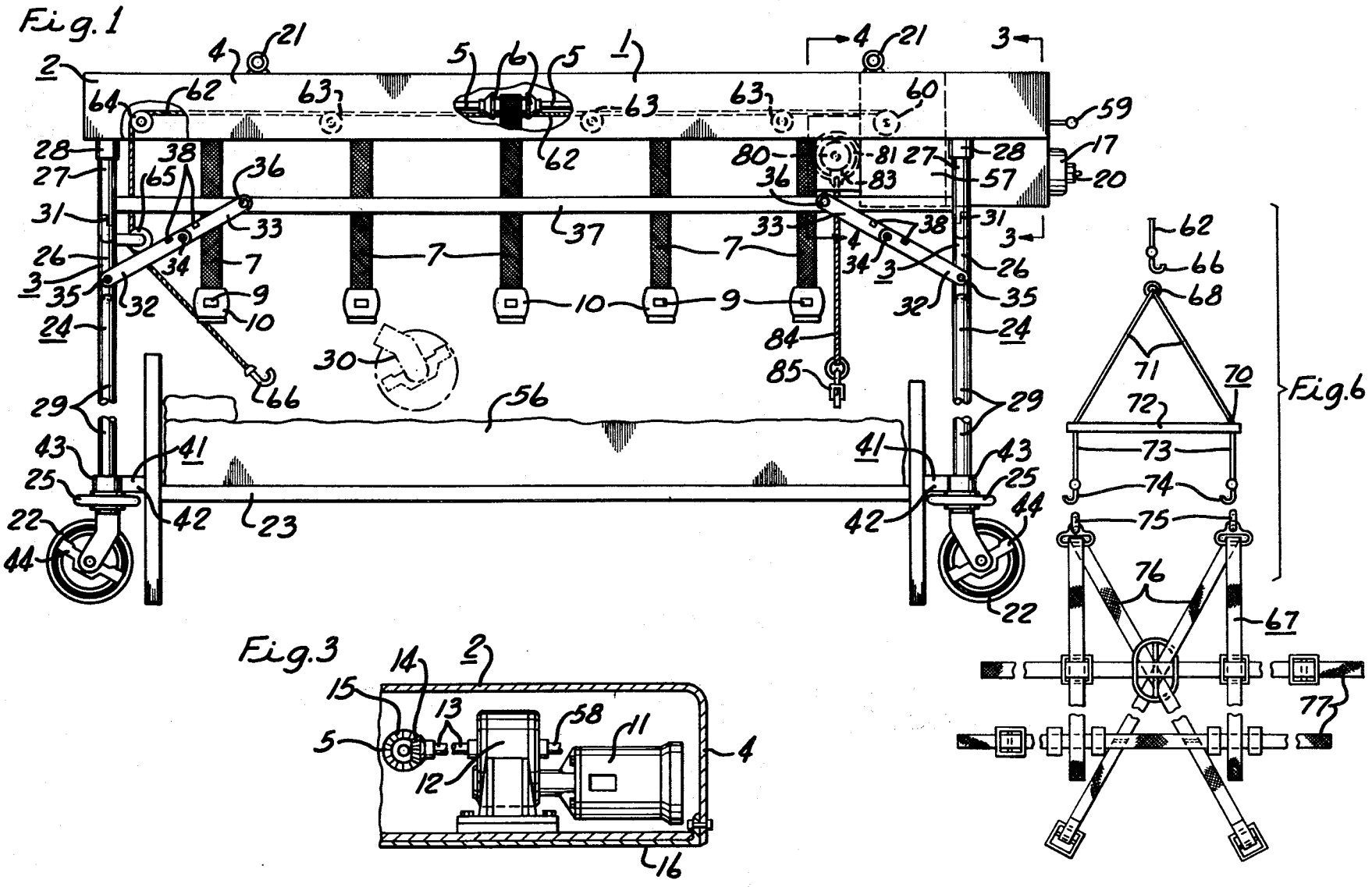
FIG. 1 is a side elevation of the invalid handling apparatus comprising this invention.
FIG. 3 is a partial sectional view taken along the line 3—3 of FIG. 1 showing a portion of motor drive means of the apparatus of FIG. 1.
FIG. 6 is the harness that may be used on an invalid in connection with a drag line or cable associated with the apparatus of FIG. 1.
Figure 2:
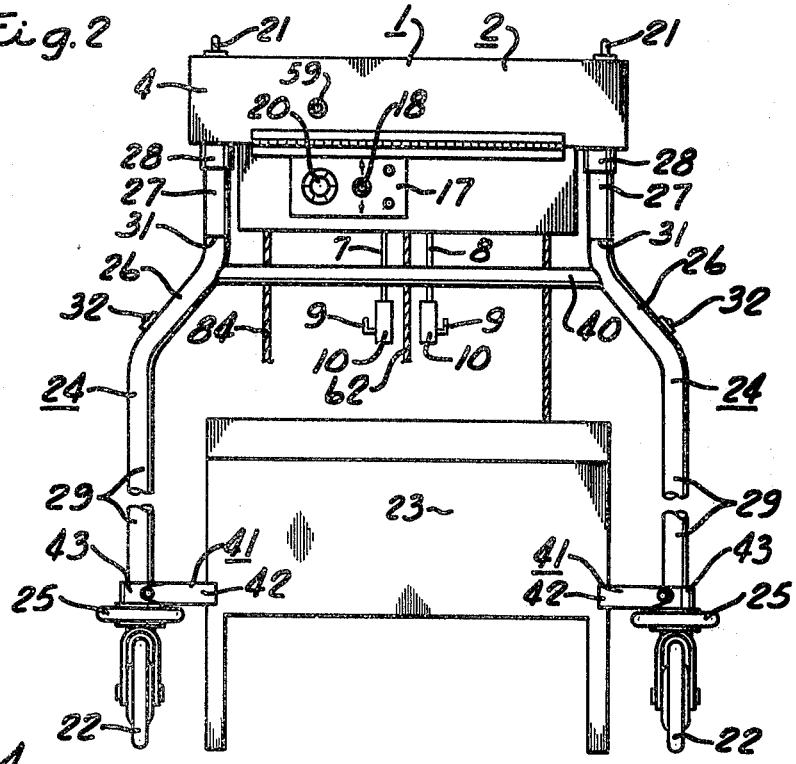
FIG. 2 is an end elevation of the invalid handling apparatus of FIG. 1.

Referring now to FIGS. 1 and 2, there is shown the invalid handling apparatus 1 comprising this invention. In using the term "invalid", it is intended to also include in its broadest sense the term "patient" as a patient may be temporarily incapacitated as far as body movement is concerned, necessitating the use of the invalid handling apparatus 1 to move the patient about in his bed or transfer the patient from his bed to another room or area.

The invalid handling apparatus 1 generally consists of the elongated frame unit 2 and the mobile support or carriage 3. The frame unit 2 is provided with the housing 4 to support the centrally rotated rotary shaft 5. In the particular embodiment shown, shaft 5 is provided with five pairs of guide spools 6 to which are attached a pair of lifting belts or strapping designated in FIGS. 1 and 2 as pairs of lifting belts 7 and 8. The ends of each of the lifting belts 7 and 8 are provided with the lifting belt connectors 10 having hook members 9 which are connected to an elongated invalid patient carrier as hereinafter will be explained. The other ends of each of the lifting belts 7 and 8 are attached together to the shaft 5 within their respective guide spools 6.

It should be noted that the lifting belts 7 and 8 have a large width and number at least five on each side to give added assurance that undue swinging of the patient or invalid will not be encountered during movement of the carriage 3. The larger the belt width together with the number of belts provided, the more the resistance of the invalid bearing carrier to swinging movement during transit with the frame unit 2. However, obviously, too large a width of lifting belts or too many lifting belts on a side of the invalid carrier would interfere with the usefulness of the apparatus. Thus, that shown in FIG. 1 is preferred.

As shown in FIG. 3, motor drive means is provided within the housing 4 and includes the reversible drive motor 11 which drives the conventional gear reducer 12, the output shaft 13 which through its bevel gear 14 drives a corresponding bevel gear 15 attached to the end of the shaft 5. The motor 11 and gear reducer 12 are supported on the base plate 16 which is securely fastened to the housing 4 as shown in FIG. 3.

As shown in FIG. 2, a control panel 17 is provided to operate the drive motor 11. Directional toggle switch 18 permits the motor 11 to be driven in either direction so that the lifting belts 7 and 8 may be caused to be wound upon the shaft 5 or unwound from the shaft 5 from between the guide spools 6. Rheostat 20 is provided to control the rate of speed of operation of drive motor 11 so that the operator of the invalid handling apparatus 1 may selectively decide the rate of rotational drive of the shaft 5.

As shown in FIGS. 1 and 2, connecting means are provided on the top of the frame unit 2 in the form of the eyelets 21 to permit lifting of the frame unit from the carriage 3 so that the frame unit 2 may be readily transported along an overhead conveyor system such as in a hospital institution so that patients may be readily transferred from one point to another without need of additional assistance.

The carriage 3 for the frame unit 2 is provided with the casters 22 so that the apparatus 1 may be rolled into position over the bed 23. The carriage 3 comprises the four quadrangularly positioned legs 24 each having a caster 22 at its bottom end with bumper protector 25 connected to the lower vertical straight section 29 and with the upper portion of each leg provided with an inwardly directed section 26 (FIG. 2) and ending in the upper vertical straight section 27. The straight section 27 is adapted to fit in the downwardly disposed sockets 28 quadrangularly positioned on the bottom of the frame unit 2. Means such as a set screw may be provided in each of the sockets 28 in order to firmly retain the vertical straight section 27 of each of the legs 24 within the downwardly disposed sockets 28. The use or employment of any means of attachment, such as screws, for retention of the carriage 3 relative to the frame unit 2 is important in those cases where transfer of the entire apparatus, the frame unit 2 and mobile carriage 3, along an overhead conveyor system is desired and for this purpose each of the quadrangularly positioned legs 24 is provided to fold inwardly and upwardly beneath and toward the bottom of the frame unit 2 as indicated in the dotted line position shown in FIG. 1. Not only are the legs 24 removed away from a position for rotational operation with respect to the floor or ground, but also can be folded inwardly and upwardly to a position wherein the length of each of the legs 24 act as a protection or safeguard device for the invalid being transferred by the unit such as on the overhead conveyor system. Also, the legs 24 in this position as shown in dotted line position in FIG. 1 at 30 prevents undue swaying of the patient or invalid on the carrier when in transit on such a conveyor system. In order for the legs at each end of the frame unit 2 to be folded as indicated above, the hinge 31 is provided in each of the legs 24 in the vertical section 27 to permit the inward rotational movement of each of the legs 24 from each of the hinges 31. In connection with each leg 24, linkage strips 32 and 33 are provided to be secured for pivotal movement at 34 and the other end of each linkage strip 32 is connected to the inwardly directed leg section 26 at 35 while the other end of each linkage strip 33 is pivotally connected to the elongated bracing member 37 at 36. The locking device 38 is provided on the linkage strips 32 and 33 to lock the strips against pivotal movement relative to the pivotal point 34 when the carriage legs are either in the floor engaging position shown in FIG. 1 or in the dotted line lifted position shown at 30. Thus, it can be relatively seen that the legs can be conveniently folded upwardly and under the frame unit by means of releasing the locking devices 38 with respect to each of the linkage strips 32 and 33 and with the legs being swung up into the position shown at 30 where they are thence again locked into position by means of the locking devices 38 and thus prevented from returning to their full downward position either by force or gravity until unlocked.

As shown in FIG. 2 a bracing member 40 is also provided at the ends of the carriage 3 between the upper ends of the inwardly directed sections 26 of each of the pairs of legs 24 located at the ends of the carriage 3.

It can be readily visualized that when the legs are in the swung upwardly position shown at 30, the patient supported on the invalid carrier from the lifting belts 7 and 8 will be protected in transit from being brought into contact with objects or obstacles passed by the apparatus while in transit and at the same time prevent undue swaying or swinging of the patient, which motion of course is brought about by the action of the overhead conveyor system per se.

Each of the legs 24 above the bumper members 25 is provided with a bed engaging member 41 which is pivotally mounted on the lower vertical section 29 of each of the legs 24 and provided with means to cause the engaging member 41 to be biased inwardly to engage in the ends of the bed 23 as shown in FIGS. 1 and 2. The engagement of the members 41 against the bed help maintain the invalid handling apparatus 1 in a steady condition relative to the bed 23 when being placed in use such as lifting or lowering an invalid from the bed 23. Each of the bed engagement members 41 is provided with an extended section 42, the end of which may be provided with a rubber abutment or other insulative material to prevent damage to the bed 23 as well as to increase the frictional biased engagement of these members against the surface of the ends of the bed. As shown in FIG. 2, the extensions 42 may be provided to be pivoted to the ring section 43 so that when the legs 24 are brought to the dotted line position shown at 30, they may be swung to be in a position parallel to the lower vertical leg section 29 of each of the legs 24 and thus not engage or otherwise be a potential hazard to an invalid while in transit.

In lieu of utilizing the bed engaging members 41 conventional caster locks such as shown at 44 in FIG. 1 only may be provided for each of the casters 22 to prevent the casters from rotating while the invalid handling apparatus 1 is in use, such as, lifting or lowering of the patient from or into the bed 23. However, the bed engaging members 41 are much more preferred since they are actually in engagement with the bed and thereby provide for a positive maintenance of a sturdy relationship of the invalid handling apparatus 1 relative to the bed 23.

Figure 5:
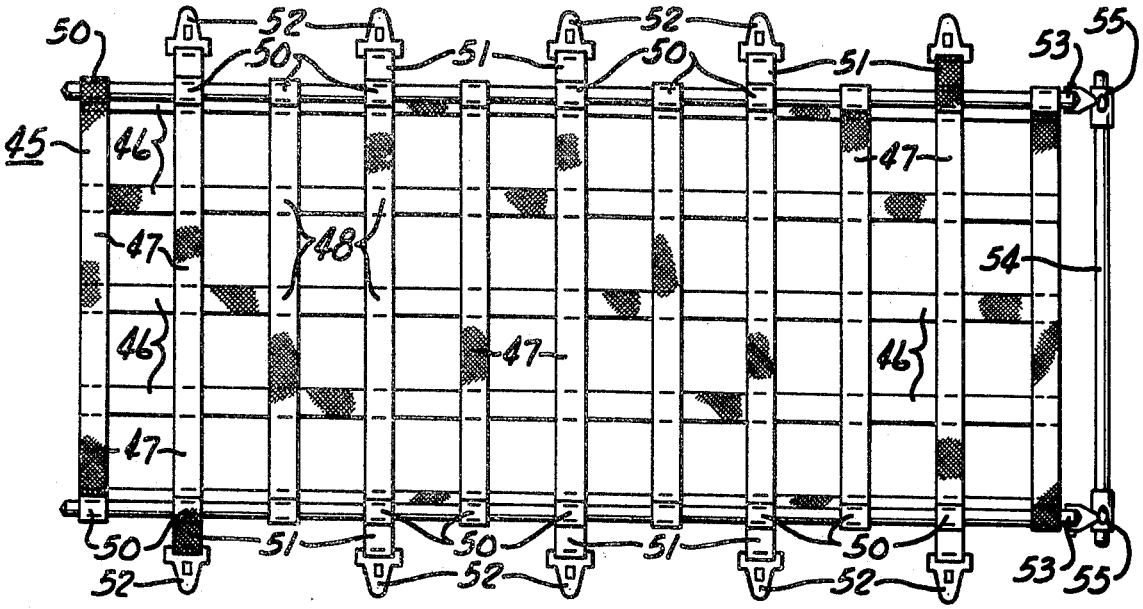
FIG. 5 is a plan view of the invalid carrier for use with the apparatus of FIG. 1.

As shown in FIG. 5, the invalid carrier 45 consists of a series of parallel and normally aligned strap members 46 and 47 which are stitched together at their points of crossing indicated at 48 to provide a flexible mat for supporting an invalid. Each end of the normally aligned strap members 47 are provided with the loops 50, some of which are provided with the extended loops 51 secured to the connectors 52. Each of the series of aligned loops 50 at the ends of the normally aligned strap members 47 are adapted to receive a rigid support bar 53 as shown in FIG. 5. The end support bar 54, in turn, is connected through the L-shaped connectors 55 to one end of each of the rigid support bars 53, thereby forming a three-piece U-shaped frame to render some rigidity to the mat 45, particularly when in use.

The L-shaped connectors 55 may be pivoted in order to render additional flexibility to the U-shaped frame unit so that it is that much less difficult to insert the rigid support bars 53 into the series of aligned loops 50 on either ends of the series of normally aligned strap members 47.

The flexible mat carrier may be readily made into the bedding 56 of the invalid or patient lying in the bed 23. Thus, when it becomes necessary to transfer the patient to another area, the sides of the bedding 56 may be removed from the mattress so that the connectors 52 will be exposed for connection to the hook members 9 of the connectors 10 on the pairs of lifting belts 7 and 8 after the latter has been lowered to a position wherein the connectors 10 may be coupled to the connectors 52.

It should be noted that one series of connectors 52 along one side of the flexible mat 45 may be connected to, say, the connectors 10 of all of the lifting belts 7 so that upon operation of the apparatus 1 and winding up of the connected lifting belts 7, an invalid positioned beneath the mat 45 may be easily rolled over in order to change the positioning of the invalid in the bed 56 or for the purpose of assisting an aide in changing the bedding of the invalid.

Figure 4:
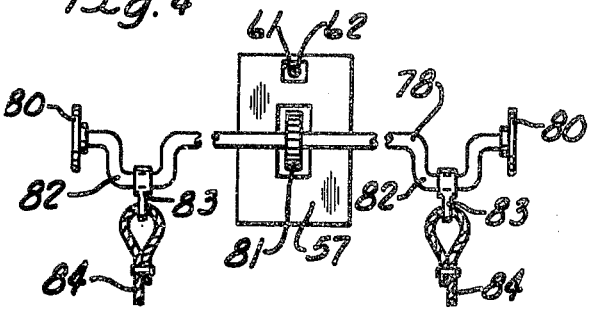
FIG. 4 is a partial sectional view taken along the line 4—4 of FIG. 1.

Reference is again made to FIG. 1 as well as FIG. 4, there is shown a gear control means 57 adapted to be driven by the motor drive means from gear reducer 12 from its shaft 58. Shaft 58 is placed in operation in lieu of shaft 13 by means of shaft control 59. The gear control means 57 provided with the winch 60 which is adapted to take up or to let out through the opening 61 in the gear control means 57, the drag line or cable 62 which passes over a series of pulley 63 and around the end pulley 64, and thence around the end bracing member pulley 55 as shown in FIG. 1. The end of the drag cable 62 may be provided with a hook such as shown at 66.

The drag cable 62 is provided to be used in conjunction with patient or invalid harness 67 as shown in FIG. 6. The hook 66 of drag cable 62 is connected to the eyelet 68 of a triangularly shaped hoist frame 70. Frame 70 is provided with the tie lines 71 which are connected at one end to the eyelet 68 and the opposite ends connected to the ends of the hoist bar 72. Hoist bar 72 is provided at its end also with the hoist lines 73 which are provided with the hooks 74 at their lower ends. The hooks 74 are adapted to be connected to the harness rings 75 of the invalid harness 67. The invalid harness 67 is of the conventional type which is provided with over-the-shoulder and between-the-legs harness straps 76 and the body straps 77 which may be securely fastened around the patient or invalid. It can readily be seen that upon connection of the hoist frame 70 to the harness rings 75 of the invalid harness 67, upon connection of the gear control means 57 to gear reducer drive shaft 58, a patient may be pulled by drag cable in a safe but convenient manner from a prone or a flat position to a sitting position as desired. Thus, the use of this apparatus particularly in connection with the drag cable 62 makes it possible for one individual to move an invalid or patient to such an upright position when necessary.

As shown in FIG. 4, the gear control means 57 may also be adapted to drive a limb exercising device which is shown to be in the form of a crank shaft at 78 rotatably supported transversely within the frame unit 2 within the housing 4 by means of the bearing blocks 80. The crank shaft 78 is rotated by means of the gear 81 which is driven by the gear control means 57.

Two crank pins 82 are provided in the crank shaft 78 to receive the eyelet members 83 to which are attached a cable 84, the bottom ends of which are provided the limb connecting straps 85 for securance around either the legs or arms of the patient. Thus, upon rotation of the crank shaft 78, the limbs of the patient secured by the straps 85 may be raised or lowered on a continual basis for the purposes of exercising the limbs.

From the foregoing description, it can be readily seen that the invalid handling apparatus 1 disclosed in the drawings is relatively simple in structure and design permitting one hospital aide to make use of this apparatus in handling or otherwise transporting an invalid. The need for such apparatus today is prevalent in view of the fact of the lack of patient handling personnel present in the hospitals and other such institutions today and also the concept that is now prevalent in today's thinking that the movement of patients or invalids in such institutions must be handled through the employment of continuous conveyor systems to efficiently and rapidly move invalids or patients from one point to another in the same institution.

I claim:

1. Invalid handling apparatus for lifting invalid patients from a bed and for transporting them from one place to another comprising an elongated frame unit, an elongated shaft rotatably supported in said frame unit and provided with a series of guide spools thereon, a pair of lifting belts for each of said guide spools with one end of each of said belts attached within each of said spools and the other ends thereof provided with connectors, motor drive means supported in said frame and including a reversible motor and gear reducer adapted to drive said shaft, downwardly disposed sockets quadrangularly positioned on the bottom of said frame unit, a carriage for supporting said frame unit for purposes of transport comprising four quadrangularly positioned legs with casters secured to their lower ends and their upper ends adapted to be received in said frame unit sockets, longitudinal bracing members secured between pairs of said carriage legs, hinge locking means in each of said legs between the upper ends thereof and the point of connection of said bracing members to said legs to permit said legs to swing inwardly of said frame unit, an elongated invalid carrier comprising a series of parallel and normally aligned strap members securely stitched at their points of crossing to provide a flexible mat for supporting an invalid, a series of loops formed in the ends of selective of said straps termination along each of the longest sides of said mat, said loops adapted to receive a ridged support bar along each of said longest sides of said mat an end support bar connected at its ends to one end of said support bars to form a three-piece U-shaped frame to effect rigidity to said mat when in use, a series of second connectors secured to selective of said strap loops and adapted to be detachably connected to said first-mentioned belt connectors.

2. The invalid handling apparatus of claim 1 characterized in that the upper ends of said carriage legs are readily detachable from said quadrangularly positioned frame unit sockets, means on the top of said frame unit to permit lifting of said frame unit from said carriage and transport along an overhead conveyor system.

3. The invalid handling apparatus of claim 1 characterized by outwardly disposed bed engaging members attached to at least two of said carriage legs at the ends of said frame unit to engage the end of the bed of the patient to maintain said handling apparatus steady when in use.

4. The invalid handling apparatus of claim 1 characterized by a gear control means adapted to be driven by said motor drive means, a winch within and driven by said gear control means, a cable provided in said frame unit for substantially its full length with its one end adapted to be driven by a winch and its other end passing over a pulley in said frame unit to be lowered and attached to a harness on a patient positioned below said frame unit.

5. The invalid handling apparatus of claim 1 characterized by a gear control means adapted to be driven by said motor drive means, a crank shaft rotatably supported transversely within said frame unit and adapted to be driven by said gear control means, two crankpins provided in said crank shaft, eyelet members rotatably mounted on said crankpins, a cable adapted to be attached to each of said eyelet members and to the limbs of a patient for exercising thereof.

6. The invalid handling apparatus of claim 1 characterized in that said bars comprising said U-shaped three piece frame are readily detached and removed from said mat to permit the latter to be made up in the bed of the patient when not in use.

7. Invalid handling apparatus for lifting invalid patients from a bed and for transporting them from one place to another comprising an elongated frame unit, an elongated shaft rotatably supported in said frame unit and provided with a series of guide spools thereon, a pair of lifting belts for each of said guide spools with one end of each of said belts attached within each of said spools and the other ends thereof provided with connectors, motor drive means supported in said frame and including a reversible motor and gear reducer adapted to drive said shaft, downwardly disposed sockets quadrangularly positioned on the bottom of said frame unit, a carriage for supporting said frame unit for purposes of transport comprising four quadrangularly positioned legs with casters secured to their lower ends and their upper ends adapted to be received in said frame unit sockets, longitudinal bracing members secured between pairs of said carriage legs, hinge locking means in each of said legs between the upper ends thereof and the point of connection of said bracing members to said legs to permit said legs to swing inwardly of said frame unit, and an elongated patient carrier including a flexible mat for supporting a patient and having a series of second connectors secured along its longest sides and adapted to be detachably connected to said first mentioned connectors.

* * * * *